United States Patent [19]

Jones, Jr.

[11] 4,048,939

[45] Sept. 20, 1977

[54] FREE-FLOODING CHAMBER STRUCTUREMOUNTABLE ON THE UNDERSIDE OF A WATERCRAFT

[76] Inventor: Allen Jones, Jr., 5028 Lauderdale Ave., Virginia Beach, Va. 23455

[21] Appl. No.: 665,715

[22] Filed: Mar. 10, 1976

[51] Int. Cl.[2] ..... B63B 1/16

[52] U.S. Cl. ..... 114/125; 9/6 R; 114/56; 114/274

[58] Field of Search ..... 114/56, 66.5 R, 66.5 H, 114/121, 125, 140, 183 R, 184, 271, 274, 288; 9/6 R, 6 P, 6 M; 115/17

[56] References Cited

U.S. PATENT DOCUMENTS

| | | | |
|---|---|---|---|
| 2,704,529 | 3/1955 | Hulett | 114/66.5 H |
| 2,757,629 | 8/1956 | Wiltse | 114/125 |
| 3,085,535 | 4/1963 | Hunt | 114/56 |
| 3,208,422 | 9/1965 | Schopmeyer | 114/66.5 H |
| 3,361,104 | 1/1968 | Glass | 114/66.5 R |
| 3,503,358 | 3/1970 | Moesly | 114/125 |
| 3,745,964 | 7/1973 | Henrich | 115/17 |
| 3,991,698 | 11/1976 | Simpson | 114/66.5 R |

FOREIGN PATENT DOCUMENTS

| | | | |
|---|---|---|---|
| 1,350,208 | 4/1974 | United Kingdom | 114/121 |

*Primary Examiner*—Trygve M. Blix

*Assistant Examiner*—Charles E. Frankfort

*Attorney, Agent, or Firm*—J. Maxwell Carson, Jr.

[57] ABSTRACT

One or more hollow elongated structures are mounted on the underside of a boat to provide wave-forming lift surfaces. Each structure defines a chamber which substantially parallels the length of the boat. Each structure has a pointed, closed forward end, an open rearward end, and an outer surface which tapers, at least in part, to provide a smooth transition between the ends and to define a planing surface that increases in area as it approaches the rearward end. When the boat is at rest, water enters the chamber and helps to stabilize the boat. When the boat gets underway, the chamber empties and the planing action of the outer surface lifts the boat and reduces its wetted surface area. Emptying water from the chamber is facilitated by ducting air or exhaust gases into the chamber. Ducting exhaust gases into the chamber has the advantages of muffling exhaust noise and reducing engine back pressure when the boat is underway, thereby enhancing engine performance. Each of the free-flooding structures preferably has the configuration of a section sliced from a hollow cylindrical tube along a plane that obliquely intersects the axis of the tube. Hydrofoils are preferably carried on the structures to assist in stabilizing and lifting the boat.

16 Claims, 8 Drawing Figures

FREE-FLOODING CHAMBER STRUCTUREMOUNTABLE ON THE UNDERSIDE OF A WATERCRAFT

BACKGROUND OF THE INVENTION

1. Field of the Invention

The present invention relates to surface watercraft and more particularly to means for stabilizing and enhancing the operating efficiency of watercraft.

2. Prior Art

Proposals have been made to provide power boats with built-in compartments which self-flood when the boat is at rest and which self-empty as the boat gets underway. The flooded compartments provide stabilization ballast.

Built-in self-flooding compartments have many disadvantages. They are difficult, if not impossible, to add to many existing hull designs. They require that flooding holes be provided through the boat's hull and, as such, destroy the watertight integrity of the hull. They do nothing to enhance operating efficiency of the boat.

Proposals have also been made to temporarily mount hollow, self-flooding, self-emptying, add-on structures on the underside of a power boat for stabilization purposes. Add-on structures proposed for this use have had a rectangular box-like shape with a blunt forward nose, and have extended only about half the length of the hull on which they are mounted.

Add-on structures have the advantages of being usable on existing hulls, of being low in cost, and of obviating the need for flooding holes through the hull. One drawback of proposed add-on structures is the need to drill fastener holes through a boat's hull to mount the structures on the hull.

A further drawback of proposed add-on structures is that they maintain a substantially uniform cross section along their lengths and, as such, do not provide a planing surface of increasing area as they extend rearwardly. The planing surface area provided by proposed blunt nosed self-flooding structures is judged inadequate to efficiently and effectively lift the boat. The shape of proposed self-flooding structures provides what can be characterized as an inefficient "wave fighting" rather than efficient "wave forming" action as the boat moves through water. These "wave fighting" shapes consume energy in throwing spray and generating heavy waves that detract from efficient operation.

SUMMARY OF THE INVENTION

The present invention overcomes the foregoing and other drawbacks of the prior art and provides novel and improved apparatus for enhancing the operating efficiency and stability of watercraft.

One or more hollow, elongated self-flooding structures are mounted on the underside of a boat hull. Each structure defines a chamber that parallels the length of the boat. The forward end region of each structures is closed and pointed. The rearward end region is open. An outer surface extends between the forward and rearward end regions and is tapered, preferably along much of its length, to provide a smooth transition between the end regions and to provide a planing surface that increases in cross-sectional area as it extends rearwardly. The increase in planing surface area near the rearward end of each structure enhances the generation of and helps to properly distribute planing lift forces.

While the dimensional configuration of the self-flooding structures should be chosen depending on the speed and loading of a particular boat, these structures preferably have lengths that are about 10 to 20 times their maximum widths. The long, narrow, tapered configuration of the structures enhances their ability to form waves efficiently at high speeds without excessive energy losses. The waves formed by the structures provide a lift "pillow" or "cushion" that enhances craft operating efficiency.

Hydrofoils are preferably carried on the self-flooding structures and operate to assist in stabilizing and lifting the boat. Mounting hydrofoils on free-flooding stabilization structures that also taper to define planing surfaces is a novel, simple and compact combination and arrangement of elements that provides many advantages over prior proposals.

In preferred practice of the present invention, the free-flooding structures have the configuration of sections sliced from a hollow cylindrical tube along a plane that obliquely intersects the axis of the tube. This configuration simplifies the formation of the structures and permits two identical free-flooding structures to be formed concurrently from a single cylindrical tube. Hollow eliptical tubes and hollow tubes of other configurations can also be used to form a pair of structures.

Emptying water from the free-flooding structures as a boat gets underway can be effected solely by inertia forces, or can be augmented by ducting air or exhaust gases into the structures. Ducting exhaust gases into the structures has the advantage of muffling engine noise and reducing engine back pressure. Exhaust gases which enter the evacuated structures are rapidly cooled and condensed, and the evacuated state of these can actually provide a negative back pressure for the boat's engine. Engine performance is accordingly enhanced, permitting the boat to achieve higher speeds than are possible where engine exhaust is ducted directly into the water. The free-flooding structures can be formed from aluminum to provide the features of good heat sinks.

The structures can also be formed from moulded rubber, whereby the rubber itself forms a gasket when clamped against the bottom of a hull. When the structures are formed from rubber, they are easily fitted to the bottom of hulls of a wide variety of shapes, and are resilient so they are not damaged on impact with obstacles in the water.

The system of the present invention is particularly well adapted for use on boat hulls formed from resin bonded glass fibers. Where used on a glass fiber hull, the structures themselves are preferably also formed from glass fiber materials and are secured to the hull through conventional bonding techniques without destroying the watertight integrity of the hull. This feature makes the system of the present invention particularly attractive as add-on kits for glass-fiber boats as well as boats made of other materials.

It is a general object of the present invention to provide novel and improved means for stabilizing and enhancing the operating efficiency of high speed watercraft of various sizes.

Other objects and a fuller understanding of the invention may be had by referring to the following description and claims taken in conjunction with the accompanying drawing.

DESCRIPTION OF THE PREFERRED EMBODIMENT

Figure 1:
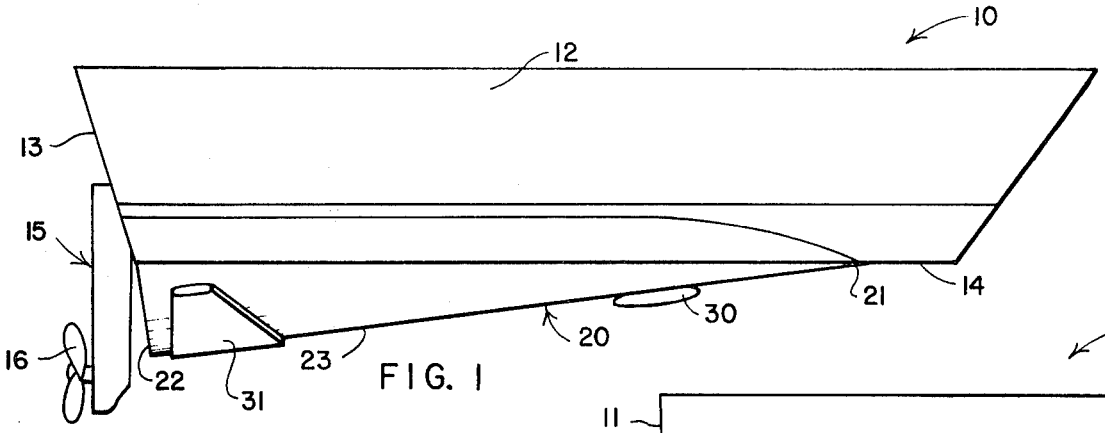
FIGS. 1 and 3 are side elevational views of two boat embodiments including features of the present invention.
Figure 2:
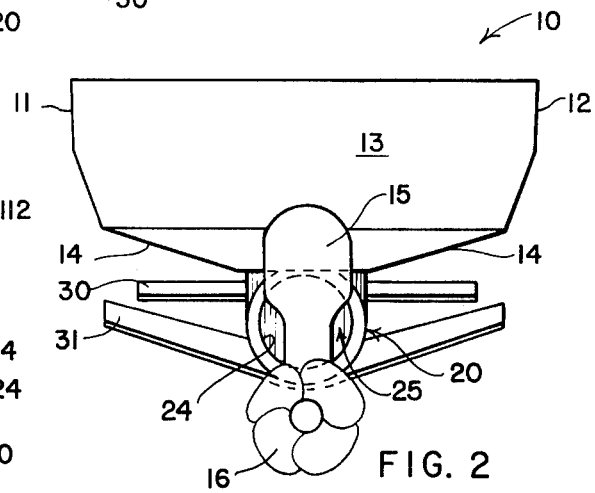
FIGS. 2 and 4 are rear elevational views of the boats of FIGS. 1 and 3, respectively.

Referring to FIGS. 1 and 2 a watercraft such as a power boat is indicated generally by the numeral 10. The boat 10 has sidewalls 11, 12, a stern wall 13, and a bottomwall 14 which join to form a hull structure.

An inboard engine drive train structure 15 depends from the stern of the boat 10. A propellor 16 is supported by the drive train structure 15 and operates to propel the boat 10. While an inboard drive is shown in the FIG. 1, it will be understood that the system of the present invention is not limited in use to any particular type of drive.

A hollow elongated structure 20 is supported on the underside of the boat 10. The structure 20 has a pointed, closed, forward end 21, an open rearward end 22, and an outer surface 23 that extends between the ends 21, 22. The structure 20 tapers along its length and increases in cross-sectional area as it approaches the rearward end 22. An opening 24 is provided in the rearward end 22. A chamber 25 is defined inside the structure 20.

When the boat 10 is at rest, water floods into the chamber 25 through the opening 24 and provides ballast to stabilize the boat 10. As the boat 10 gets underway, water empties from the chamber 25 through the opening 24 and thereby reduces the effective mass of the boat 10.

The outer surface 23 acts as a planing surface when the boat 10 is underway. Lift forces generated by the planing action of the surface 23 lift the boat 10 and effect a reduction of its wetted surface area. Inasmuch as the area of the surface 23 increases as the surface 23 extends rearwardly, greater lift forces are generated toward the rear of the structure 20 than are generated toward its front, and a desirable distribution of these forces is accordingly attained.

The structure 20 preferably has a length that is within the range of about ten to twenty times it maximum width. This ratio provides a long narrow configuration that enhances efficient wave forming. Minimal energy is lost by such a structure in the generation of spray and heavy waves. Waves formed by the structure provide a lift pillow or cushion that enhances operating efficiency.

A pair of hydrofoils 30, 31 are supported on the structure 20. The forward foil 30 extends substantially horizontally and transversely of the structure 20. The rearward foil 31 has upwardly inclined foil portions that will pierce the water's surface when the boat 10 is steeply banked. Straight and surface-piercing foil structures of these types are well known to those skilled in the art and need not be further described. The foils 30, 31 help stabilize the boat 10 when the boat is at rest, and generate lift forces when the boat is underway. The distribution of lift forces generated by the foils 30, 31 is controlled by selecting the relative sizes and angles of attack of the forward and rearward foils 30, 31.

In preferred practice, the hull of the boat 10, the structure 20, and the foils 30, 31 are all formed from resin bonded glass fiber materials. These elements can be formed separately and bonded together with conventional glass fiber bonding techniques and without destroying the watertight integrity of the hull or can be gasketed and secured together by watertight fasteners. Moreover, these elements can be formed integrally in a factory molding operation.

Figure 4:
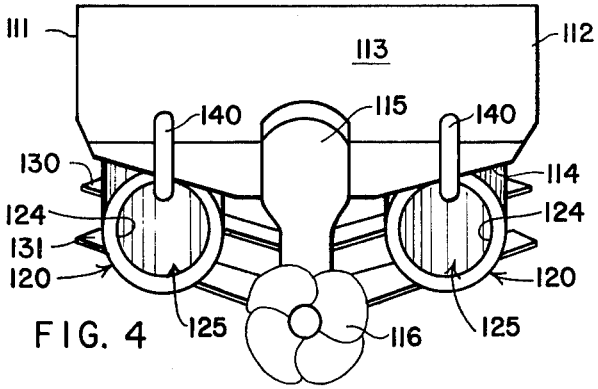
Figure 3:
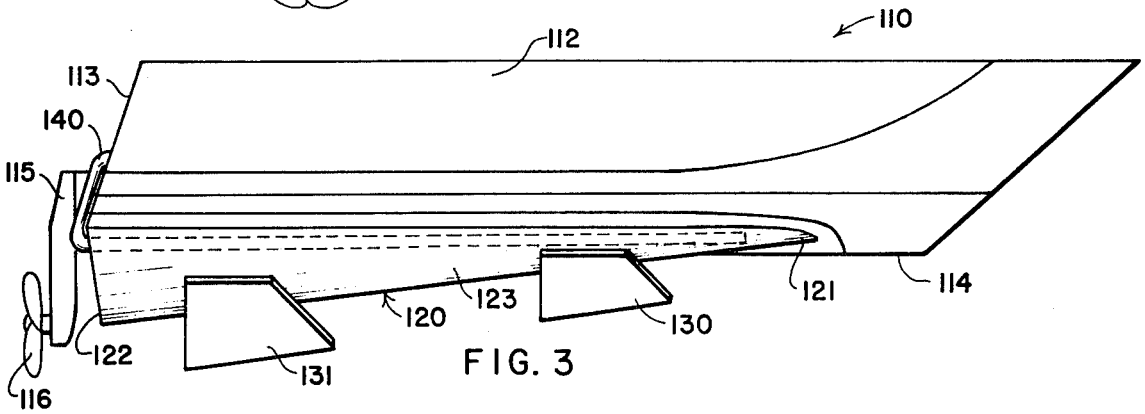
Figure 5:
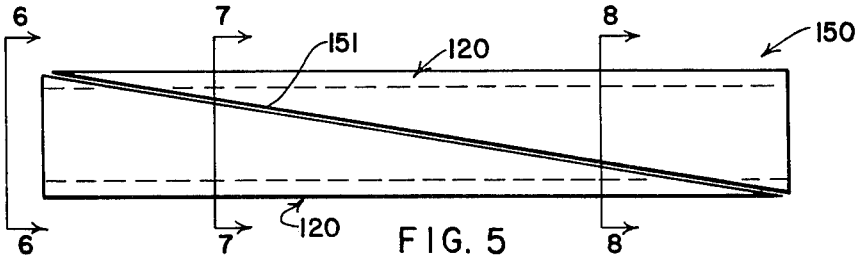
FIG. 5 is a schematic view illustrating how two stabilizing sections can be formed from a single cylindrical tube; and, FIGS. 6, 7 and 8 are end elevational and sectional views as seen from planes indicated by lines 6—6, 7—7, 8—8 in FIG. 5.
Figure 6:
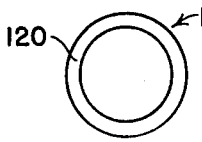
Figure 7:
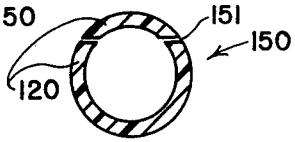
Figure 8:
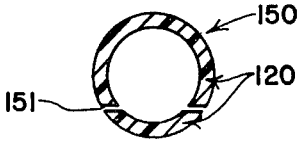

Referring to FIGS. 3 and 4, another power boat embodiment is indicated generally by the numeral 110. The boat 110 has sidewalls 111, 112, a stern wall 113, and a bottom wall 114 which join to form a hull structure.

An inboard engine drive train structure 115 depends from the stern of the boat 110. A propellor 116 is supported by the drive train structure 115 and operates to propel the boat 11.

Two hollow elongated structures 120 are supported on the underside of the boat 110. The structures 120 have pointed, closed forward ends 121, open rearward ends 122, and outer surfaces 123 that extend between the ends 121, 122. Openings 124 are provided in the rearward ends 122. Chambers 125 are defined inside the structures 120. The structures 120 are, in short, substantially identical to the structure 20 and operate in the same manner as the structure 20. By providing two of the structures 120, the stabilization, lift, and wave forming benefits obtained are increased over those which obtain where a single structure 20 is used.

A pair of hydrofoils 130, 131 are supported on the structures 120. Both of the foils 130, 131 have upwardly inclined foil portions designed to pierce the water's surface during a steep bank of the boat 110.

Emptying water from the structures 20, 120 can be facilitated by ducting air or engine exhaust gases into the chambers 25, 125. Referring to FIGS. 3 and 4, a pair of conduits 140 extend into the chambers 125. Ducting engine exhaust gases through the conduits 140 into the chambers 125 has the additional advantages of muffling exhaust noise and improving engine operating efficiency. When the chambers 125 are emptied of water, as when the boat 110 is underway, exhaust gases ducted into the chambers 125 are not opposed by significant water pressure forces and tend to rapidly condense. A negative back pressure can actually be provided by this arrangement.

The conduits 140 can be used simply as breather pipes to admit and discharge air from the structures 120. Where the conduits 140 serve this purpose, their upper, rearward end regions open to the atmosphere. When the boat 110 gets underway, the conduits 140 duct air into the chambers 125. When the boat 110 slows down or stops, the conduits 140 facilitate the exhaust of air from the chambers 125 as water re-enters these chambers.

Referring to FIGS. 5–8, the structures 120 can both be formed concurrently from a common length of cylindrical tube 150. A slot 151 is cut in the tube 150 along a plane that obliquely intersects the axis of the tube 150 to produce two identical structures 120. A feature of structures 20, 120 formed in this manner is that their outer surfaces 23, 123 have substantially constant radii of curvature along their lengths. Arcuately curved outer surfaces 23, 123 have the advantage of exposing minimal areas of contact to the water surrounding the structures 20, 120, whereby the ratio of exposed outer wetted surface area of the structures to the volume enclosed by the chambers 25, 125 is minimized.

Forward portions of the structures 20, 120 can, in some applications, be used as fuel tanks. Such a use of the structures 20, 120 diminishes their ability to lighten the mass of the boat when it gets underway, and this use is therefore not preferred.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exist in the invention disclosed.

What is claimed is:

1. Apparatus for enhancing the operating efficiency and stability of a power boat, comprising:

a. a hollow, elongated structure exteriorly mountable on the underside of a boat to define a chamber extending exteriorly along the underside of and substantially paralleling the length of the boat;

b. the structure having forward and rearward end regions and having an outer surface which extends in length therebetween;

c. the forward end region defining a substantially pointed, closed end formation positionable substantially adjacent the forward end of the wetted surface area of the underside of the boat when said boat is at rest in the water;

d. the rearward end region defining a rearwardly facing opening positionable completely beneath the underside of the boat communicating with the chamber permitting the passage of water therethrough (i) to substantially fill the chamber and thereby stabilize the boat when the boat is at rest in the water and (ii) to empty the chamber and thereby reduce the effective mass of the boat when the boat is underway; and e. the outer surface being tapered along its entire length to progressively increase the cross-sectional area of the structure as it provides a smooth transition from the pointed forward end formation to the rearward end region thereby forming a planing surface which operates to lift the boat in the water when it is underway to reduce the wetted surface area of the boat.

2. The apparatus of claim 1 wherein the length of the structure is at least 20 times the maximum width of the structure.

3. The apparatus of claim 1 wherein the outer surface, as viewed in cross-sectional planes taken substantially perpendicular to the length of the structure, is substantially arcuately curved.

4. The apparatus of claim 3 wherein the radius of curvature of the outer surface is substantially constant along the length of the structure.

5. The apparatus of claim 1 wherein the structure has substantially the configuration of a section sliced from a hollow cylindrical tube along a plane that obliquely intersects the axis of the tube.

6. The apparatus of claim 1 additionally including hydrofoil means supported on the structure for assisting the planing action of the outer surface in lifting the boat when the boat is underway.

7. The apparatus of claim 6 wherein the hydrofoil means includes a pair of hydrofoils supported on the structure at spaced forward and rearward locations.

8. The apparatus of claim 1 additionally including conduit means extending through the opening into the chamber for supplying air thereto to facilitate the emptying the chamber as the boat gets underway.

9. The apparatus of claim 1 additionally including conduit means for ducting engine exhaust gases into the chamber.

10. Apparatus for enhancing the operating efficiency and stability of a power boat, comprising:

a. a hollow elongated structure exteriorly mountable on the underside of a boat to define a chamber extending exteriorly along the underside of and substantially paralleling the length of the boat;

b. the structure having forward and rearward end regions and having an outer surface which extends in length therebetween;

c. the forward end region defining a substantially pointed, closed end formation positionable substantially adjacent the forward end of the wetted surface area of the underside of the boat when said boat is at rest in the water;

d. the rearward end region defining a rearwardly facing opening positionable completely beneath the underside of the boat communicating with the chamber permitting the passage of water therethrough (i) to substantially fill the chamber and thereby stabilize the boat when the boat is at rest in the water and (ii) to empty the chamber and thereby reduce the effective mass of the boat when the boat is underway;

e. the outer surface being tapered along its entire length to provide a smooth transition between the end regions; and, f. hydrofoil means supported on the structure for lifting the boat in the water when it is underway to reduce the wetted surface area of the boat.

11. The apparatus of claim 10 wherein the hydrofoil means includes a pair of hydrofoils supported on the structure at spaced forward and rearward locations.

12. The apparatus of claim 10 wherein the outer surface increases the cross-sectional area of the structure as it extends from the forward end region to the rearward end region and forms a planing surface which assists the hydrofoil means in lifting the boat as the boat gets underway.

13. The apparatus of claim 12 wherein the length of the structure is at least 20 times its maximum width.

14. The apparatus of claim 12 wherein the outer surface, as viewed in cross-sectional planes taken substantially perpendicular to the length of the structure, is substantially arcuately curved.

15. The apparatus of claim 14 wherein the radius of curvature of the outer surface is substantially constant along the length of the structure.

16. The apparatus of claim 10 wherein the structure has substantially the configuration of a section sliced from a hollow cylindrical tube along a plane that obliquely intersects the axis of the tube.

* * * * *